US008447198B2

(12) United States Patent
Fujita et al.

(10) Patent No.: US 8,447,198 B2
(45) Date of Patent: May 21, 2013

(54) DETECTOR AND ROLLER ARRANGEMENT FOR AN IMAGE FORMING APPARATUS

(75) Inventors: Junpei Fujita, Kanagawa Prefecture (JP); Ryuuichi Mimbu, Kanagawa Prefecture (JP); Kenji Sengoku, Kanagawa Prefecture (JP); Osamu Ichihashi, Kanagawa Prefecture (JP)

(73) Assignee: Ricoh Company, Ltd., Tokyo (JP)

( * ) Notice: Subject to any disclaimer, the term of this patent is extended or adjusted under 35 U.S.C. 154(b) by 199 days.

(21) Appl. No.: 13/033,302

(22) Filed: Feb. 23, 2011

(65) Prior Publication Data

US 2011/0206399 A1 Aug. 25, 2011

(30) Foreign Application Priority Data

Feb. 24, 2010 (JP) ..... 2010-038320

(51) Int. Cl.
*G03G 15/00* (2006.01)
*G03G 15/01* (2006.01)

(52) U.S. Cl.
USPC ..... 399/49; 399/302

(58) Field of Classification Search
USPC ..... 399/49, 302, 303, 308, 301
See application file for complete search history.

(56) References Cited

U.S. PATENT DOCUMENTS

| | | | | |
|---|---|---|---|---|
| 6,901,234 | B2 | 5/2005 | Ogiyama et al. | |
| 6,947,693 | B2 | 9/2005 | Kamiya et al. | |
| 7,502,583 | B2 | 3/2009 | Sawai et al. | |
| 7,532,370 | B2 | 5/2009 | Kudo et al. | |
| 7,742,721 | B2 | 6/2010 | Mimbu | |
| 7,773,928 | B2 | 8/2010 | Ogiyama et al. | |
| 7,831,161 | B2 * | 11/2010 | Hirayama et al. | 399/49 |
| 2008/0232867 | A1 | 9/2008 | Minbu et al. | |
| 2009/0060611 | A1 | 3/2009 | Minbu | |
| 2009/0142083 | A1 | 6/2009 | Minbu | |
| 2009/0279927 | A1 | 11/2009 | Fujita | |
| 2010/0061741 | A1 | 3/2010 | Minbu | |
| 2010/0067952 | A1 | 3/2010 | Fujita et al. | |
| 2010/0142985 | A1 | 6/2010 | Minbe et al. | |
| 2010/0221029 | A1 | 9/2010 | Minbu et al. | |
| 2010/0272478 | A1 | 10/2010 | Ichihashi | |

FOREIGN PATENT DOCUMENTS

| | | | |
|---|---|---|---|
| JP | 10-104898 | | 4/1998 |
| JP | 2001-34032 | | 2/2001 |
| JP | 2005-181874 | * | 7/2005 |
| JP | 2006-337814 | * | 12/2006 |
| JP | 2008-241958 | | 10/2008 |
| JP | 2009-8741 | | 1/2009 |
| JP | 2009-210823 | * | 9/2009 |

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An image forming apparatus includes an endless intermediate transfer belt rotatably stretched over a plurality of rollers, and a detector to read a pattern on the intermediate transfer belt. One of the rollers includes a first portion disposed opposite an area on the intermediate transfer belt including a pattern passing position, and a second portion not including a pattern passing position. The first portion has a diameter smaller than that of the second portion thereof, and an elastic material is superimposed on the second portion only. The detector is disposed between a second roller disposed upstream of the first roller and a third roller disposed downstream of the first roller, and opposite the intermediate transfer belt.

15 Claims, 12 Drawing Sheets

$$SF1=\frac{(MXLNG)^2}{AREA}\times\frac{\pi}{4}\times 100$$

$$SF2=\frac{(PERI)^2}{AREA}\times\frac{1}{4\pi}\times 100$$

DETECTOR AND ROLLER ARRANGEMENT FOR AN IMAGE FORMING APPARATUS

CROSS-REFERENCE TO RELATED APPLICATIONS

The present application claims priority from Japanese patent application number 2010-038320, filed on Feb. 24, 2010, the entire contents of which are incorporated by reference herein.

BACKGROUND OF THE INVENTION

1. Field of the Invention

The present invention relates to an image forming apparatus such as a copier, printer, facsimile machine, or the like, and in particular relates to an image forming apparatus using an intermediate transfer device.

2. Description of the Related Art

In image forming apparatuses such as copiers, printers, or facsimile machines, a transfer process is performed in which a toner image obtained by developing an electrostatic latent image formed on a photoreceptor (being a latent image carrier) is transferred to a recording medium such as a sheet.

In such a transfer process, there is a case of transferring a monochromatic image in which the toner image is directly transferred from the photoreceptor to the sheet. Otherwise, in a case of transferring a full color image using an intermediate transfer body, the color-separated toner images of each color formed on the photoreceptor are sequentially transferred to the intermediate transfer body in a primary transfer process, and subsequently the toner images of each color superposedly transferred on the intermediate transfer body are en bloc transferred to the sheet in a secondary transfer process.

A higher precision in the obtained image has been desired for both the monochromatic image and the full color image recently. As one approach to obtain the high quality in the formed image, image density is minutely controlled by detecting the density of the toner on the intermediate transfer body and by controlling the toner density in the developing device and the developing conditions. In the full color image formation, in particular, patterns on the intermediate transfer body are detected so as to control color shift in main scanning and sub-scanning directions, thereby obtaining a high quality image even in the superposedly obtained color image.

When detecting the toner density, the condition of the detection target surface may adversely affect the detection precision. For example, projections and scratches on the surface to be detected of the intermediate transfer body may cause detection errors.

In particular, in a case of using a movable belt as an intermediate transfer body on which visualized images formed on each of a plurality of latent image carriers are sequentially transferred in the primary transfer process, the superposedly transferred images are en bloc transferred to the recording sheet, and thereafter, the belt-shaped intermediate transfer body is cleaned by a cleaning device, when the toner density and the patterns on the belt are detected by any detection means, the detection output results may include variations due to fluttering or winding of the belt. Typically, the toner density or the patterns are detected at a position where the intermediate transfer belt is wound over rollers. In such a case, foreign particles on the inner surface of the belt or projections on the outer surface of the belt may result in unexpected detection outputs.

Accordingly, to detect the toner density on the intermediate transfer body precisely, JP-2008-241958-A discloses a technology and an image forming apparatus including a detector to detect at least one of a toner amount and a color shift amount in a reference image transferred onto the intermediate transfer belt by the transfer means, a correction unit to correct at least one of the toner amount and the color shift amount based on the detection result by the detector, and a support roller for detection contacting an inner side of the intermediate transfer belt and having a flat portion with a substantially constant diameter at its center and gradually reducing in size toward outside from the flat central portion, in which the detector detects the reference image at a surface opposite the portion where the detection support roller contacts the inner side of the belt. However, this disclosed art cannot improve the detection precision because the roller is formed of a metal and the belt slips along it too easily.

SUMMARY OF THE INVENTION

Accordingly, the present invention provides a novel image forming apparatus capable of controlling the image density with higher precision and preventing uneven density and decrease in the image density from occurring over time.

As an aspect of the present invention, an image forming apparatus includes an endless belt-shaped intermediate transfer body rotatably stretched over a plurality of rollers and a detection sensor to read a pattern on the intermediate transfer body. At least a first roller of the plurality of rollers includes a first portion disposed opposite an area on the intermediate transfer body including a passage position of the pattern, and a second portion contacting the intermediate transfer body not including a passage position of the pattern, and a diameter of the first portion of the roller is smaller than that of the second portion of the roller, and at least a surface of the second portion of the roller is formed of an elastic member. Further, the detection sensor to read the pattern is disposed within an area from a position in which a second roller disposed slightly upstream of the first roller in the moving direction of the intermediate transfer body completes to contact the intermediate transfer body to a position in which a third roller disposed downstream of the first roller starts to contact the intermediate transfer body, and opposite the intermediate transfer body.

These and other objects, features, and advantages of the present invention will become apparent upon consideration of the following description of the preferred embodiments of the present invention when taken in conjunction with the accompanying drawings.

DESCRIPTION OF THE PREFERRED EMBODIMENTS

Preferred embodiments of the present invention will now be described with reference to drawings.

Figure 1:
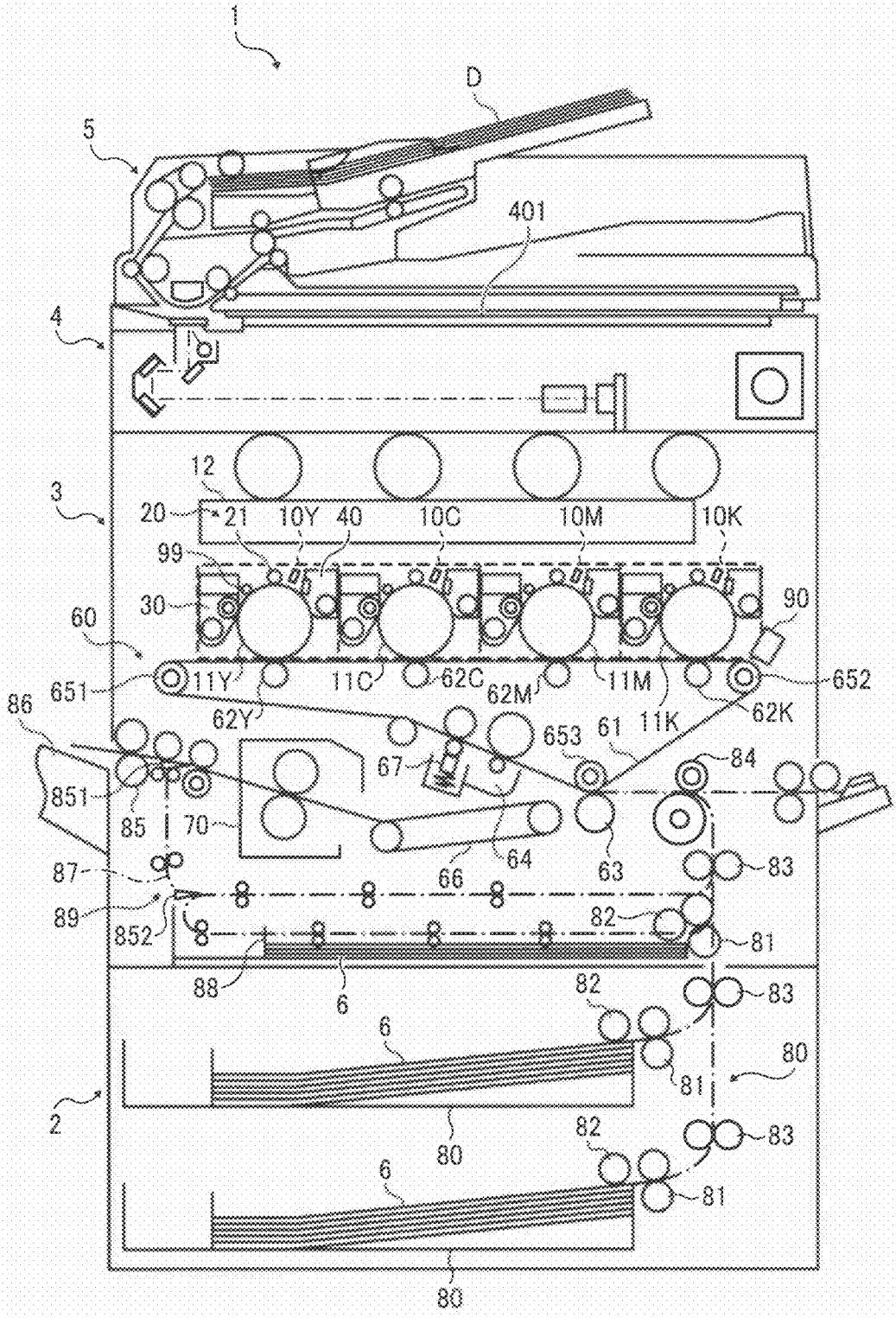
FIG. 1 is a schematic configuration of an image forming apparatus as an embodiment of the present invention employing an intermediate transfer belt as a transfer member.

FIG. 1 is a diagram illustrating a structure using an intermediate transfer belt as a member onto which an image is transferred according to one embodiment of the present invention. Although FIG. 1 shows an example of a so-called tandem type image forming apparatus as a representative example using an intermediate transfer belt, the present invention is not limited only to this exemplary embodiment.

Referring to FIG. 1, an example in which the present invention is applied to a full-color image forming apparatus will now be described.

An image forming apparatus 1 in general includes, from top to bottom, an automatic document feeder (ADF) 5, a scanner (or a reader) 4, an image forming section 3, and a sheet feed section 2. The ADF 5 automatically feeds originals placed thereon one by one. The scanner 4 reads out content of the originals. The image forming section 3 forms a toner image. The sheet feed section 2 stores and feeds recording media 6 such as recording sheets.

The image forming section 3 is disposed in the center of the image forming apparatus 1. The image forming section 3 includes, in its substantially central portion, four image forming units 10 of four colors of yellow (Y), magenta (M), cyan (C), and black (K), each of which is a process cartridge. Four image forming units 10 are arranged in parallel in the horizontal direction as is the case for a so-called tandem type.

Above the four image forming units 10Y, 10C, 10M, and 10K, an exposure unit 12 is provided. The exposure unit 12 radiates exposure light based on image data of each color onto a charged surface of each photoreceptor drum 11 to thus form a latent image. Below the four image forming units 10Y, 10C, 10M, and 10K, there is provided a transfer unit 60 including an intermediate transfer belt 61. The intermediate transfer belt 61 is an endless belt, and includes a base formed of a heat-resistant material such as a polyimide or polyamide and having a medium resistance. The endless belt 61 is wound over rollers 651, 652, and 653, thereby being rotatably supported by the rollers.

All of the image forming units 10 are formed similarly. Therefore, if a color distinction is not indicated, suffixes of Y, C, M, and K will be omitted. Each image forming unit 10 includes a photoreceptor 11 of a corresponding color. Around each photoreceptor 11, there are provided a charging unit 20 to apply electric potential to the surface of the photoreceptor 11, a developing unit 30 to develop a latent image formed on the surface of the photoreceptor 11 with toner of each color to form a toner image, a lubricant applicator to apply the lubricant, and a cleaning unit 40 including a cleaning blade to clean the surface of the photoreceptor 11 after the transfer of the toner image.

The photoreceptor 11 is formed of a metal or an organic material such as amorphous silicon or selenium. The organic photoreceptor 11 is manufactured to include a conductive support base and a photoconductive layer formed thereon. The photoconductive layer includes a resinous layer in which filler is dispersed, an electric charge generation layer, and an electric charge transport layer superimposed one on another. The photoreceptor 11 may further include a protective layer in which filler is dispersed, provided on the surface of the photoconductive layer.

The photoconductive layer may be a single layer structure including a charge generation substance and a charge transport substance. However, the photoconductive layer formed of a layered structure including separate charge generation and charge transport layers has excellent sensitivity and resistivity.

The charge generation layer is prepared as follows. A coating liquid is prepared by dispersing a pigment having charge generation function with a binder resin if appropriate in a suitable solvent, using a ball mill, attritor, sand mill or ultrasonic dispersion machine. The thus prepared coating liquid is coated on the conductive support base and is dried. Specific examples of the binder resin includes: polyamide, polyurethane, epoxy resin, polyketone, polycarbonate, silicon resin, acrylic resin, polyvinyl butyral, polyvinyl formal, polyvinyl ketone, polystyrene, polysulfone, poly-N-vinylcarbazole, polyacrylamide, polyvinylbenzol, polyester, phenoxy resin, vinyl chloride-vinyl acetate copolymer, polyvinyl acetate, polyphenylene oxide, polyvinyl pyridine, cellulose resin, casein, polyvinyl alcohol, polyvinyl pyrrolidone, and the like. The amount of the binder resin is from 0 to 500 parts by weight and preferably from 10 to 300 parts by weight versus 100 parts by weight of a charge generating substance.

The charge transport layer is prepared by: dissolving or dispersing a charge transport material and a binder resin in a proper solvent to obtain a coating liquid; coating the obtained coating liquid on the charge generation layer; and drying the coated surface. The charge transport materials include a positive-hole transport material and an electron transport material. Examples of binder resins include thermoplastic or thermo-curing resins such as: polystyrene, styrene-acrylonitrile copolymer, styrene-butadiene copolymer, styrene-maleic anhydride copolymer, polyester, polyvinyl chloride, vinyl chloride-vinyl acetate copolymer, polyvinyl acetate, polyvinylidene chloride, polyallate, phenoxy resin, polycarbonate, cellulose acetate resin, ethylcellulose resin, polyvinyl butyral, polyvinyl formal, polyvinyl toluene, poly-N-vinylcarbazole, acrylic resin, silicon resin, epoxy resin, melamine resin, urethane resin, phenol resin, alkyd resin, and the like.

By providing the protective layer on the photoconductive layer, the durability of the photoreceptor 11 is improved and a highly sensitive photoreceptor 11 without any defect can be prepared.

Specific materials for use in the protective layer include: ABS resin, ACS resin, olefin-vinyl monomer copolymer, polyether chloride, allyl resin, phenol resin, polyacetal, polyamide, polyamide-imide, polyacrylate, polyallylsulfone, polybutylene, polybutylene terephthalate, polycarbonate, polyallylate, polyethersulfone, polyethylene, polyethylene terephthalate, polyimide, acrylic resin, polymethylpentene, polypropylene, polychlorovinylidene, epoxy resin, and the like. Among the above examples, polycarbonate or polyallylate can most preferably be used. Other than the above materials, a substance prepared by fluorine resins such as polytetrafluoroethylene or silicon resins, or a substance prepared from those resins dispersed with inorganic filler formed from titanium oxide, tin oxide, potassium titanate, silica or any organic filler, may be added to the protective layer to improve abrasion resistance. A content of filler in the protective layer is dependent on the type of filler or conditions of the electrophotographic process using the photoreceptor 11. The amount by weight of the filler in the topmost surface in the protective layer 9 versus all solid content is preferably from 10% by weight to 50% by weight, and more preferably 30% by weight or less.

The charging unit 20 includes a charging roller 21. The charging roller 21 includes a conductive metal core serving as a charger and an elastic layer having a medium resistance coated on an exterior of the metal core. The charging roller is connected to a power source and is supplied with predetermined voltage of a direct current (DC) or an alternating current (AC). The charging roller 21, discharging ions, is formed of an elastic material resin roller. The charging roller 21 may include non-organic materials such as carbon black and ion conductive material to adjust electric resistance.

The charging roller 21 is disposed across a slight gap relative to the photoreceptor 11. This slight gap is provided such that any spacer with a certain thickness is wound around both end portions of the charging roller 21 where no image is to be formed and the surface of the spacer is brought into contact with the surface of the photoreceptor 11. The charging roller 21 may be provided either close to or contacting the photoreceptor 11. The charging roller 21 is configured to have a roller shape and charge the photoreceptor 11 at a portion in the proximity of the photoreceptor 11. In a case in which the charging roller 11 is disposed close to but not contacting the photoreceptor 11, smears due to the toner remaining on the photoreceptor 11 after transfer process do not attach to the charging roller 11. Moreover, the charging roller 21 is provided with a charge cleaning roller, not shown in the figure, to contact and clean the surface of the charging roller 21.

The developing unit 40 includes a developing sleeve disposed opposite the photoreceptor 11. The developing sleeve includes a magnetic field generation means in its interior. Below the developing sleeve, an agitation and conveying screw is provided. The agitation and conveying screw serves to mix toner supplied from a toner bottle, not shown, with a developer and convey the mixed toner and developer to the developing sleeve while agitating it. A two-component type developer formed of toner and magnetic carriers to be conveyed by the developing sleeve is regulated to have a predetermined thickness of the developer layer and is carried on the developing sleeve. The developing sleeve while being opposite the photoreceptor 11 moves in the same direction of the movement of the photoreceptor 11, carries the developer and supplies toner to the photoreceptor 11. Toner cartridges each containing unused toner of a specific color are detachably mounted to a space above the photoreceptor 11. The toner is supplied according to the necessity to each of the developing units 40 by toner conveyance means such as a Mono pump and air pump. It is possible to make the rapidly consumed toner cartridge for black toner to have a large capacity.

The cleaning blade 40 includes a cleaning blade and a holder to keep the blade, and the like. The blade is pressure-contacted with the photoreceptor 11, thereby removing the residual toner from the photoreceptor 11. In addition, a mechanism to bring the cleaning blade into contact with the photoreceptor 11 and to detach the cleaning blade from the photoreceptor 11 is provided, whereby a controller of the image forming apparatus 1 causes the cleaning blade to be arbitrarily contacted to and detached from the photoreceptor 11. The cleaning blade is contacted with the photoreceptor 11 in a counter method or reverse rotation method to remove residual toner from the photoreceptor 11 and additives such as talc, caolin, and calcium carbonate remaining on the recording medium as smears, thereby cleaning the photoreceptor 11. The removed toner and the like are conveyed to a waste toner container, not shown, by a waste toner collection coil and stored therein.

The toner cleaned and removed from the cleaning unit 40 may either be collected via the toner conveyance member and finally by a service person or reused in the developing process as recycled toner.

The transfer unit 60 includes an intermediate transfer belt 61 on which toner images are superimposed, a primary transfer roller 62, a secondary transfer roller 63, and the like. The primary transfer roller 62 allows toner images on the photoreceptor 11 to be transferred to and superimposed on the intermediate transfer belt 61. The secondary transfer roller 63 allows the superimposed toner images to be transferred onto the recording medium 6. The transfer unit 60 further includes a support roller 653, an opposite roller, provided at an inner side of the transfer belt 61 at a position opposite the secondary transfer roller 63.

The primary transfer roller 62 to primarily transfer the toner image formed on the photoreceptor 11 onto the intermediate transfer belt 61 is provided at a position opposite each photoreceptor 11 with the intermediate transfer belt 61 in between. The primary transfer roller 62 is connected to a power supply and is supplied with predetermined direct current (DC) voltage or alternating current (AC) voltage. A polarity of the supplied voltage is opposite that of the potential of toner, thus the toner is extracted from the photoreceptor 11 to move toward the intermediate transfer belt 61, whereby a primary transfer is performed. In addition, this primary transfer roller 62 is preferably made to be a semiconductor material to adjust electric resistance by including non-organic material such as a carbon black and ion conductive material. Differences in electric resistance of the primary transfer roller 62 do not adversely affect transferability, but transferability changes considerably when the difference in image area ratio is large, and therefore, stable transferability cannot be maintained. This is because more current voltage flows to areas in the transfer nip in which toner does not exist. As a result, when the image ratio (the proportion of the area of the recording medium occupied by the final formed image) is small, the transfer voltage is lowered and electric field necessary sufficient for transfer is not obtained. In particular, when the resistance of the primary transfer roller 62 is low, effect of the resistance of toner present in the transfer unit increases. The less the resistance of the primary roller 62 is, the greater the effect of the resistance of toner becomes. When constant current control is used, it is preferred that the high resistant primary transfer roller 62 be used. However, if the resistance exceeds $5\times10^8\Omega$, the current leaks, disturbing formation of toner image. Then, it is preferred that the resistance of the primary transfer roller be in a range of more than $1\times10^5\Omega$ and less than $5\times10^8\Omega$. The phenomenon in which more current flows to areas in which toner does not exist occurs due to the toner resistance effect described above. The above phenomenon also occurs because the potential difference between the primary transfer voltage supplied to the metal core provided in the center of the primary transfer roller 62 and the potential of the photoreceptor 11 is larger where toner is not developed yet than areas in which toner has been developed, and that the transfer current tends to flow to the areas with larger potential difference. This phenomenon occurs with the image forming apparatus 1 in which the toner image has the same polarity as the charged polarity of the photoreceptor 11, and the toner is developed at a potential-discharged portion by exposure on the photoreceptor 11, thereby forming a toner image on the photoreceptor 11. Specifically, the potential of the photoreceptor 11 where the toner image is not formed is high and the potential of the photoreceptor 11 where the toner image is formed is low. The transfer potential, however, has a polarity opposite that of the photoreceptor. Then, the difference in the potential between the primary transfer voltage and the photoreceptor potential voltage is larger in the non-toner-developed portion than in the toner-developed portion. The preferred resistance of the primary transfer roller 62 in this case is within a range of from $5\times10^7\Omega$ to $5\times10^8\Omega$.

The toner image superimposed on the intermediate transfer belt 61 is secondarily transferred to the recording medium by the secondary transfer roller 63. The secondary transfer roller 63 is connected to the power source similarly to the case of the primary transfer roller 62, and is supplied with predetermined direct current (DC) voltage and alternating current (AC) voltage. The polarity of the supplied voltage is opposite that of the potential of the toner. The toner is extracted and moved to the recording medium being conveyed, in the secondary transfer operation.

The secondary transfer roller 63 includes a cylinder-shaped metal core, an elastic layer formed on an outer periphery of the metal core, and a surface layer made of resin materials formed on an outer periphery of the elastic layer.

Examples of metals to form the metal core include metallic materials such as stainless steel and aluminum but are not limited thereto. As an elastic layer formed on the metal core, rubber materials are commonly used to form a rubber layer 65*b*. This is because the secondary transfer roller 63 requires elasticity to secure the secondary transfer nip by deforming the secondary transfer roller 63. The hardness of the secondary transfer roller 63 is preferably 70 degrees or less on the Asker C hardness scale.

In addition, since the cleaning blade 22 is used as a cleaning means for the secondary transfer roller 63, too soft an elastic layer may cause the contact state between the cleaning blade 22 and the elastic layer to be unstable and a proper cleaning angle cannot be obtained. Then, the harness of the elastic layer is preferably 40 degrees or more on the Asker C hardness scale.

Furthermore, the secondary transfer roller 63 formed of an insulating material does not serve to transfer the toner image to the recording medium. Therefore, the secondary transfer roller 63 is preferably formed of a foamed resin to which conductive function is imparted and preferably has a thickness of 2 mm to 10 mm. Specific examples of conductivity imparting materials include EPDM and Si rubber in which carbon black is dispersed, NBR having an ion conductive function, and urethane rubber.

Many foamed resin materials to be used in the elastic layer have a high chemical affinity with toner and have a high friction coefficient. Requirements to the surface layer of the secondary transfer roller 63 include a lower friction coefficient and higher releaseability relative to toner. Therefore, the surface layer of the secondary transfer roller 63 is resistivity-adjusted by adding any resistivity-controlling material to fluorine resin-based resins.

The secondary transfer roller 63 rotates while contacting the intermediate transfer belt 10. Then, a slight difference in linear velocity occurring between the intermediate transfer belt 10 and the secondary transfer roller 63 adversely affects the driving of the intermediate transfer belt 10. Then, slidability of the surface layer of the secondary transfer roller 63 is required with respect to the intermediate transfer belt 10, and the friction coefficient of the uppermost surface layer needs to be 0.4 or less.

Moreover, the intermediate transfer belt 61 includes a belt cleaning unit 64 that cleans a surface of the intermediate transfer belt 61 after the secondary transfer.

A mechanism in which the support roller 653 and the intermediate transfer belt 61 are contacted with and retracted from each other is also provided. A controller, described later, in the main body of the image forming apparatus 1 may appropriately control these actions.

Further, this image forming apparatus 1 includes a lubricant application unit 67 to coat a lubricant to the intermediate transfer belt 61. The lubricant application unit 67 includes a solid lubricant stored in a fixed case, a brush roller to scrape off the solid lubricant while contacting it and coat the scraped-off lubricant onto the intermediate transfer belt 61, and a lubricant coating blade to level off the lubricant applied by the brush roller. The solid lubricant is pressed against the brush roller side by a pressure spring, and scraped off by the brush roller and consumed over time, but is constantly contacted against the brush roller by being pressed by the pressure spring. The brush roller while rotating coats the scraped-off lubricant onto the surface of the intermediate transfer belt 61.

The lubricant application unit having the same function as above may be provided to the photoreceptor 11.

In the present embodiment, the lubricant coating blade as a lubricant leveling-off means is provided in contact with the surface of the intermediate transfer belt 61 downstream in the moving direction of where the brush roller coats the lubricant. The lubricant coating blade is formed of elastic rubber, has a function of a cleaning means, and contacts the intermediate transfer belt 61 in the reverse direction relative to the moving direction of the intermediate transfer belt 61. A dried solid hydrophobic lubricant may be used for the solid lubricant. Other than zinc stearate, metallic compounds including fatty acid groups such as stearic acid, oleic acid, paltimic acid, and the like, may also be used. Further, waxes such as candelilla wax, carnauba wax, rice wax, vegetable wax, jojoba oil, beeswax, lanolin, and the like may be used for the solid lubricant.

The intermediate transfer belt 61 is formed of a single or multiple layers using polyvinylidene fluoride (PVDF), ethylene tetrafluoroethylene (ETFE), polyimide (PI), polycarbonate (PC), and the like, and conductive materials such as carbon black and the like dispersed therein, with an entire volume resistivity adjusted to be in a range from $10^8$ to $10^{12}$ Ωcm and a surface resistivity in a range from $10^9$ to $10^{13}$ Ωcm. If necessary, a release layer may be additionally formed on the top of the intermediate transfer belt 61. The release layer may use fluorine resins such as ethylene tetrafluoroethylene copolymer (ETFE), polytetrafluoroethylene (PTFE), polyvinylidene fluoride (PVDF), perfluoroalkoxy (PEA), tetrafluoroethylene-hexafluoropropylene copolymer (FEP), polyvinylfluoride (PVF), and the like, but not limited thereto.

The intermediate transfer belt 61 may be manufactured by molding, centrifugal molding, and the like. If necessary, the surface of the belt may be polished.

If the volume resistivity of the intermediate transfer belt 61 exceeds the above range, a higher bias voltage needs to be supplied to the belt for image transfer. This results in a drastic cost rise for the power supply and is not desirable. Further, the charged potential of the intermediate transfer belt 61 in the transfer process and the transfer sheet releasing process becomes high and the self discharge of electricity becomes difficult, resulting in a need to provide some sort of discharging means. Furthermore, if the volume resistivity and the surface resistivity become less than the above range, the charged potential quickly attenuates, which is favorable for the discharging by self discharge of electricity but is not favorable because the current flows in the surface direction and toner dispersion occurs. Accordingly, the volume and surface resistivities of the intermediate transfer belt 61 need to be in the above ranges.

Measurements of the volume and surface resistivities are performed by using a high resistivity meter (Hiresta IP from Mitsubishi Chemical) connected with HRS probe (with an inner electrode diameter of 5.9 mm and inner diameter of ring electrode of 11 mm). The volume resistivity is the value taken 10 seconds after applying voltage of 100 volts to the surface and backside of the intermediate transfer belt 61, and the surface resistivity is the value taken as above but by applying voltage of 500 volts.

A fixing unit 70 to fix the toner image on the recoding sheet semi-eternally is provided below the transfer unit 60. The fixing unit 70 mainly includes a fixing roller 71 and a pressure roller 72. The fixing roller 71 includes a halogen heater in an insider thereof. The pressure roller 72 is disposed opposite the fixing roller 71 and pressed against the fixing roller 71. The fixing unit 70 is controlled by a controller so that the fixing condition is adjusted to be optimal depending on whether the image is full-color or monochrome, single-sided or duplex copying, or depending on the type of the recording medium.

When the duplex copying mode is selected, the recording medium 6 is conveyed as follows. The recording medium 6 an image on one side of which is fixed is conveyed to a recording medium reversing unit 89 by a switching claw 851, is reciprocated in the part of the reverse conveying path 87 formed by a plurality of rollers and guide members arranged at predetermined positions in the reverse conveying path 87, to be reversed upside down. The recording medium 6 is again switched by another switching claw 852 to be returned to the conveyance path for image formation, is conveyed on the conveying path to a transfer position 30. Then, an image is transferred onto a backside of the recording medium 6 and is fixed thereon. The recording medium 6 is finally discharged onto a sheet discharge tray 86 by a sheet discharge roller 85.

In this instance, when one sheet of the recording medium 6 is to be copied, after the recording medium 6 is reversed upside down, the recording medium 6 passes through the reverse conveyance path 87 of the recording medium reversing unit 89. Then, the recording medium 6 waits at a registration roller 84 until the image forming unit 10 forms an image thereon, and the image is formed on the recording medium 6 by the transfer roller 63. Next, after the image is transferred and fixed on the backside of the recording medium 6, the recording medium 6 is finally discharged onto the sheet discharge tray 86 by the sheet discharge roller 48.

When a plurality of recording media 6 is to be copied, a set number of recording media one side of which is formed with a toner image are once stored in a recording medium reverse container 88 inside the recording medium reversing unit 89. Next, the recording media are fed by a sheet feed roller 82, are separated one by one by a separation roller 81, and are caused to be waited again at the registration roller 84 until the image forming unit 10 forms an image thereon. This time, after the image is transferred to and fixed on the backside of the recording media 6, the recording media 6 are finally discharged onto the sheet discharge tray 86 by the sheet discharge roller 85.

In addition, the image forming apparatus 1 of the present invention includes a detection sensor 90 to detect a toner deposition amount of the toner image transferred onto the intermediate transfer belt 61.

Various kinds of detection sensors 90 used for the toner deposition amount detection are available. The detection sensor 90, photo-sensor (P-sensor) or optical sensor includes a laser emission diode (LED) 91 as a light emitting part and a photo diode (PD) or a photo transistor (PTr) 92 as a light receiving part which are mounted on a base 93 in combination. A sensor light 94 emitted from the LED 91 is received by the PD or PTr 92

Figure 2:
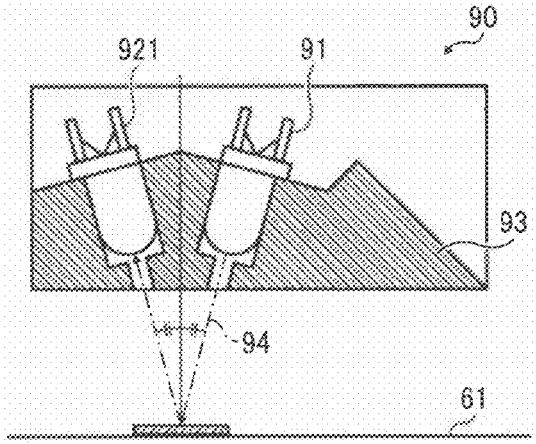
FIG. 2 shows a first type (of detection sensor including a specular reflection light receiving element detecting only the specular reflection.
Figure 3:
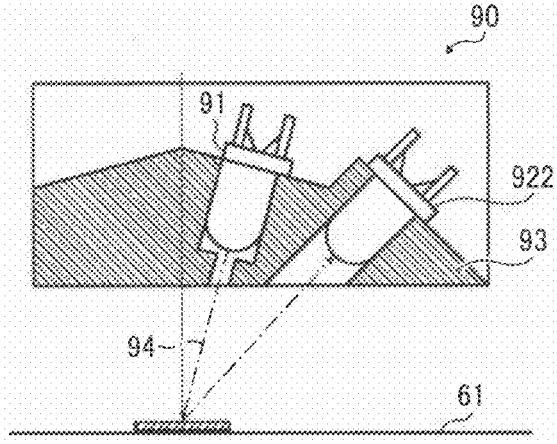
FIG. 3 shows another second type of detection sensor including a diffuse reflection light receiving element detecting only the diffuse reflection.
Figure 4:
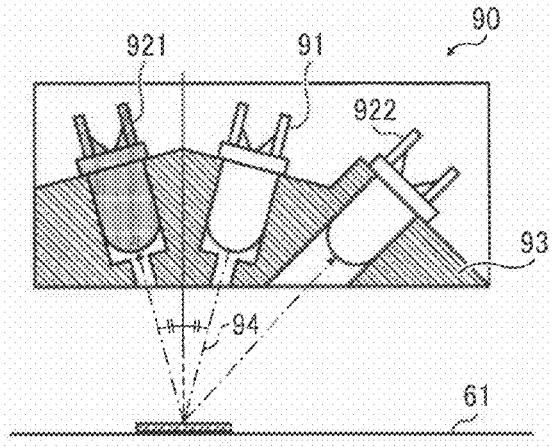
FIG. 4 shows further another third type of detection sensor including a specular reflection light receiving element and a diffuse reflection light receiving element.

FIGS. 2 through 4 are diagrams each showing a structure of the detection sensor 90.

FIG. 2 shows a type (1) detection sensor including a specular reflection light receiving element 921 detecting only the specular reflection light. FIG. 3 shows another type (2) detection sensor including a diffuse reflection light receiving element 922 detecting only the diffuse reflection light. FIG. 4 shows further another type (3) detection sensor including both of the specular reflection light receiving element 921 and the diffuse reflection light receiving element 922.

Characteristics of the above three types of sensors will now be described briefly.

The type (1) specular reflection optical sensor has a characteristic that output changes due to the concavity and convexity of the detection target. This type of sensor has been used widely as a sensor 90 to detect toner deposition amount of the apparatus forming monochrome images.

Output characteristic when detecting black toner and color toner using this type (1) detection sensor 90 will be explained sequentially.

Figure 5:
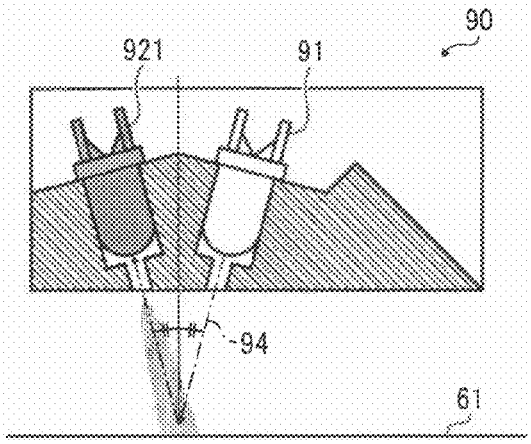
FIG. 5 is a schematic view illustrating a state of light reflected from the intermediate transfer belt on which little toner is deposited.

FIG. 5 is a schematic view illustrating a state of light reflected from the intermediate transfer belt on which little toner is deposited. As illustrated in FIG. 5, on a smooth surface, as a detection target, of the intermediate transfer belt 61 on which toner is not deposited at all, most of sensor light 94 radiated by the LED 91 is specular reflection, most of which enters the specular reflection receiving element 921, thereby obtaining a high output value.

Figure 6:
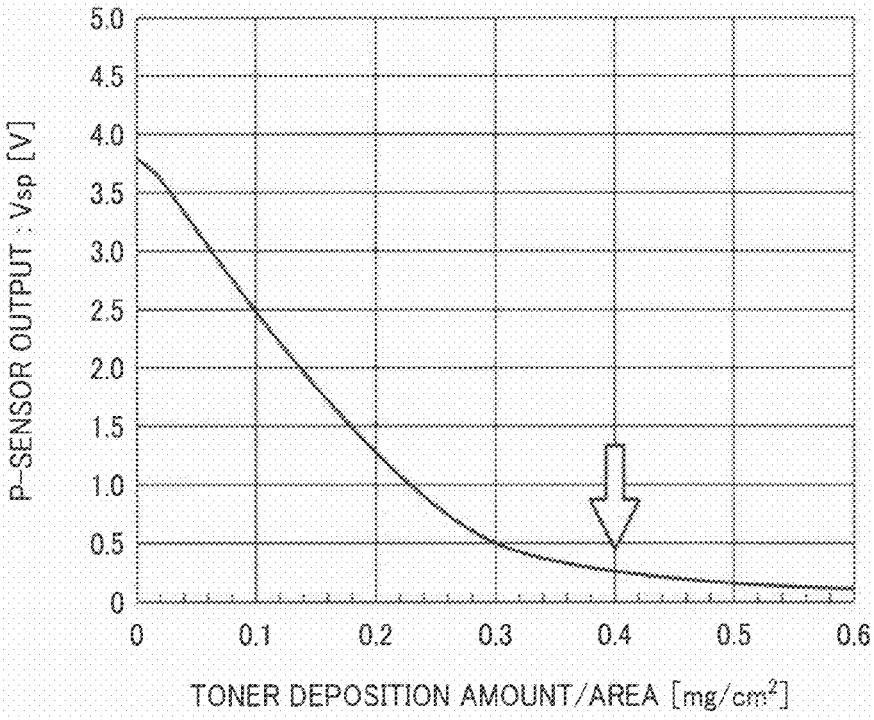
FIG. 6 is a graph showing a relation between the toner deposition amount of black toner and specular reflection output characteristic of the optical sensor.

FIG. 6 shows a graph showing a relation between the toner deposition amount of black toner and specular reflection output characteristic of the optical sensor.

As the toner deposition amount is increased from this state, the radiated sensor light 94 is diffused at a toner surface or is absorbed almost entirely in the case of black toner. As a result, the specular reflection output characteristics relative to the toner deposition amount shows a monotonously reducing curve without any inflection point as illustrated in FIG. 6.

If more than a certain amount of toner is deposited and it comes to a state in which the concavity and convexity state of the surface of the toner layer does not change anymore, the output is saturated and shows a substantially constant value.

In obtaining a toner deposition amount from the specular reflection light output, since the ratio between the smoothness of the background portion of the surface of the intermediate transfer belt 61 and the roughness of the toner patch portion, that is, the ratio of the relative-specular glossiness is proportional to the toner deposition amount and is therefore normalized by the following formula (1).

[Formula 1]

$$R[n] = \frac{(\Delta Vsp_Reg.[n] - Vmin_Bk)}{(\Delta Vsg_Reg. - Vmin_Bk)} \times 100 \quad (1)$$

wherein ΔVsg_Reg. is an increased output value of the specular reflection of the belt background portion, ΔVsp_Reg. is an increased output value of the specular reflection of the toner patch portion, and Vmin_Bk is ΔVsp_Reg. in an area where the sensor output is saturated. Therefore, by investigating a relation between the ratio of the relative-specular glossiness and the toner deposition amount by previous experiments, toner deposition amount can be ascertained.

As described above, as the concavity and convexity state of the surface of the toner layer becomes constant, the output becomes saturated. Then, the toner deposition amount of the solid image cannot be detected. Therefore, from the relation between the black toner deposition amount and the specular reflection characteristics of the detection sensor as illustrated in FIG. 6, detection can be performed as long as the toner deposition amount is from approximately 0 to 0.4 mg/cm$^2$.

Figure 7:
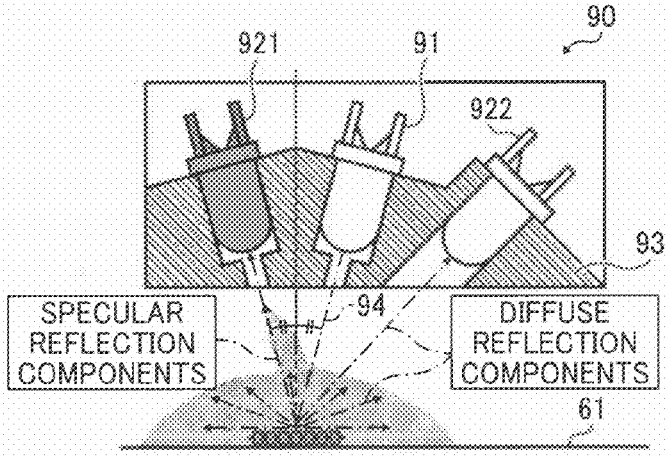
FIG. 7 is a schematic view illustrating a state of the light reflected from the intermediate transfer belt on which a large amount of color toner is deposited.

FIG. 7 is a schematic view illustrating a state of the reflected light from the intermediate transfer belt on which a large amount of color toner is deposited.

Figure 8:
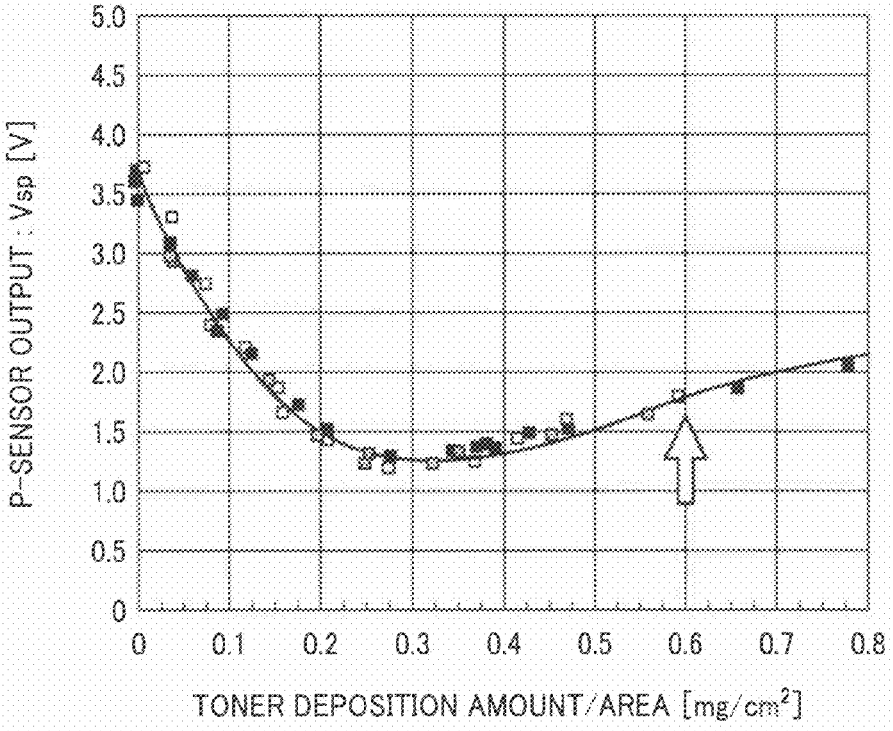
FIG. 8 is a graph showing a relation between the color toner deposition amount and outputs from the optical sensor having specular reflection output characteristics.

FIG. 8 is a graph showing a relation between the color toner deposition amount and outputs from a detection sensor having specular reflection output characteristics.

In the case of color toner, as illustrated in FIG. 7, as the toner deposition is gradually increased, the radiated sensor light 94 diffuses at a toner surface, and the pure specular light component tends to decrease as in the case of black toner. However, the light once absorbed by the toner and again radiated, that is, the diffuse light component, tends to increase as the toner deposition amount increases. Thus, the specular reflection light output characteristics compared to the toner deposition amount show a monotonously reducing curve in the area in which the toner deposition amount is low, but show a characteristic curve having such an inflection point as to turn to monotonously increase in an area in which the toner deposition amount is medium or high, as illustrated in FIG. 8. When the characteristic curve has such an inflection point, the toner deposition amount can be detected correctly only when the deposition amount is from 0 to the inflection point corresponding amount.

Then, when detecting the color toner amount using the type (1) detection sensor 90, the detectable toner deposition amount range is narrower than in the case of the black toner.

Figure 9:
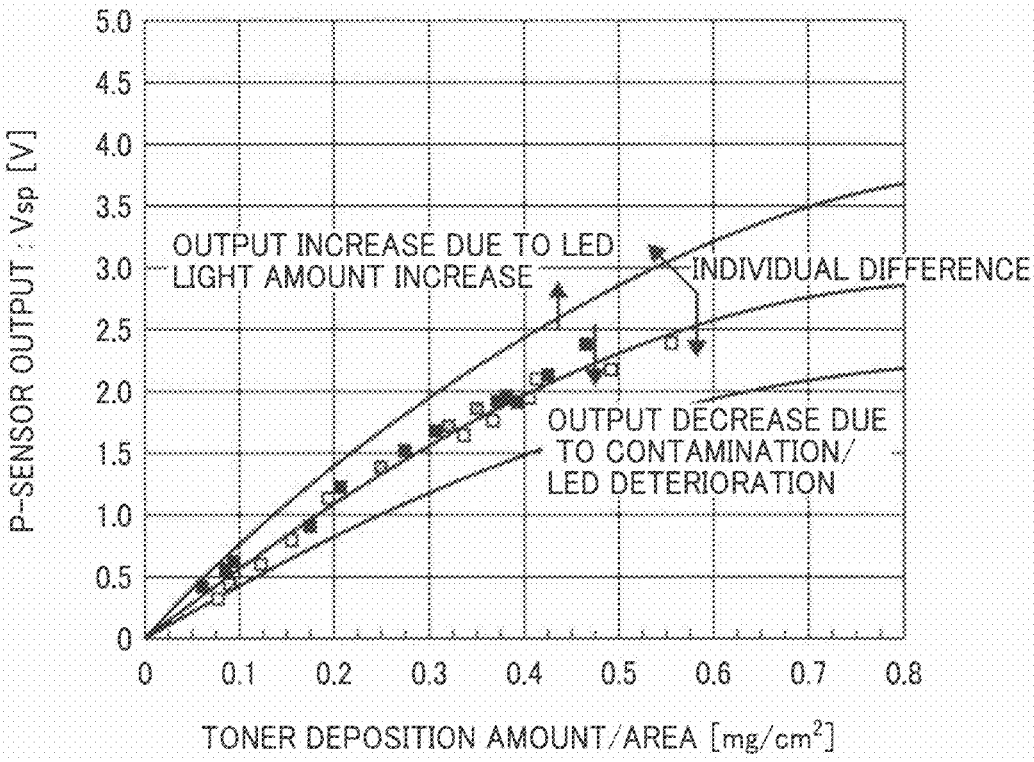
FIG. 9 is a graph showing a relation between the color toner deposition amount and the outputs from the detection sensor having diffuse reflection output characteristics.

FIG. 9 is a graph showing a relation between the color toner deposition amount and the outputs from the detection sensor having diffuse reflection output characteristics.

Figure 10:
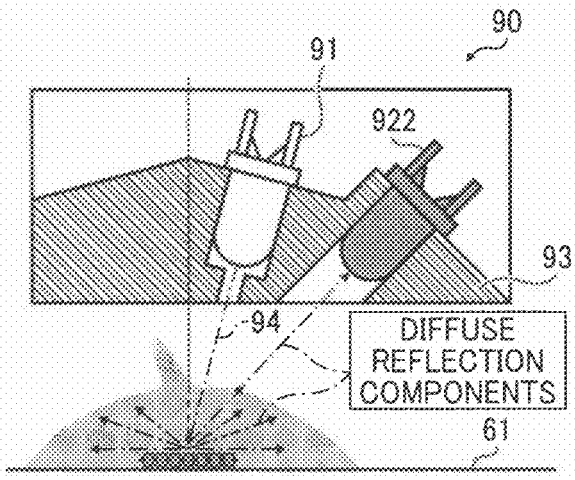
FIG. 10 is a schematic view illustrating a state of the detection sensor to detect the diffuse reflection light from the intermediate transfer belt on which a large amount of color toner is deposited.

FIG. 10 is a schematic view illustrating a state of the detection sensor to detect the diffuse reflection light from the intermediate transfer belt on which an abundance of color toner is deposited.

To overcome the aforementioned defect when the color toner deposition amount is detected by the type (1) specular reflection light receiving element 921, a diffuse reflection light receiving element 922 of the type (2) has come to be used to detect the diffuse reflection light having outputs monotonously increasing relative to the deposition amount as illustrated in FIG. 9.

The difficulty in handling this diffuse reflection light receiving element 922 lies in the calibration of the sensor.

In the case of the specular reflection light receiving element 921, making use of the constant relation between the toner deposition amount and the ratio between the sensor outputs at the toner deposited area and the background area of the intermediate transfer belt 61, the deposition amount can be obtained easily by converting the sensor output to the deposition amount. However, in the case of the diffuse reflection light, since the output in the background part of the intermediate transfer belt 61 is substantially zero, the toner deposition amount cannot be obtained by the above ratio-based calculation. Then, the diffuse reflection light output itself needs to be calibrated to a predetermined absolute value.

However, the diffuse reflection outputs fluctuate depending on the temperature of the light emitting element (LED) 91, the light amount decrease over time due to the optical attenuation of the light emitting element (LED) 91, or the output decrease due to smears on the sensor detection window. The LED 91 has a disadvantage in that the detection error increases over time due to the impossibility of the sensitivity calibration of the sensor even though initially a correct toner deposition amount can be detected.

Figure 11:
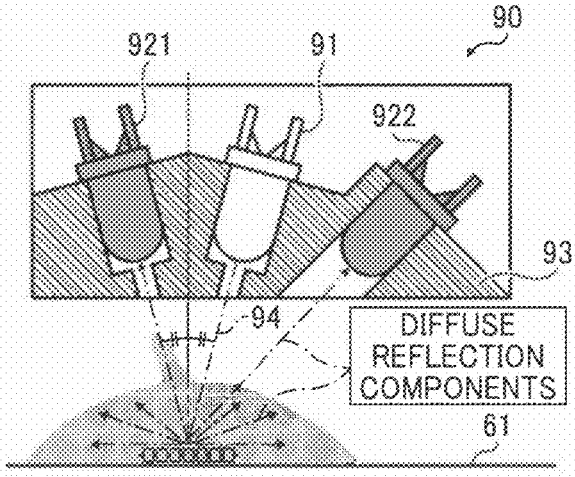
FIG. 11 is a schematic view illustrating a state of the detection sensor to detect the specular reflection light and the diffuse reflection light from the intermediate transfer belt on which a large amount of color toner is deposited.

FIG. 11 is a schematic view illustrating a state of the detection sensor to detect the specular reflection light and the diffuse reflection light from the intermediate transfer belt on which an abundance of color toner is deposited.

As illustrated in FIG. 11, the detection sensor 90 of the type (3) having two outputs of specular and diffuse reflection light outputs overcomes disadvantages in the above two types, performs correction or calibration of the optical sensor as follows, and obtains a density of the toner patch (toner deposition amount) from the output value of the diffuse reflection light receiving element 921 which receives the diffuse reflection light.

Specifically, first, a sensitivity correction coefficient α is calculated based on an output value of the specular reflection receiving element 921 and an output value of the diffuse reflection receiving element 922 when detecting each toner patch. Next, using the sensitivity correction coefficient α, the output value of the specular reflection receiving element 921 is separated into specular reflection components and diffuse reflection components. Then, using a ratio between the output value (background portion output value) of the surface of the photoreceptor 11 and the intermediate transfer belt 61, on the one hand, and the specular reflection components on the other, the specular reflection components are converted to a normalized value β(n) from 0 to 1.

Then, using the output value from the diffuse reflection light receiving element 922 multiplied by the normalized value, the diffuse reflection light components from the photoreceptor 11 and the surface of the intermediate transfer belt 61 are extracted from the output value of the diffuse reflection receiving element 922 to obtain the diffuse reflection light components from the toner. Then, using the normalized value β(n) and the diffuse reflection light components, a sensitivity correction coefficient η is calculated to correct the sensitivity of the output value of the diffuse reflection receiving element 922. The diffuse reflection light component from the toner extracted from the output value of the diffuse reflection light receiving element 922 is multiplied by the sensitivity correction coefficient η to correct or calibrate the output value of the diffuse reflection light receiving element 922. The toner deposition amount is obtained from the output value of the diffuse reflection light receiving element 922 corrected or calibrated by the sensitivity correction coefficient η.

Fluctuations of the output value from the light receiving element 92 due to the characteristic change of the light emitting element 91 and the light receiving element 92 due to changes in the temperature and the like are corrected or calibrated by the sensitivity correction coefficients α and η, thereby correcting the relation between the output value of the light receiving element 92 and the toner deposition amount to be constant. Accordingly, detection of the toner deposition amount can be optimally performed by the detection sensor 90 over time.

The image forming apparatus 1 according to one embodiment of the present invention includes a detection sensor 90 to optically detect the toner deposition amount and the detection sensor 90 includes a specular reflection light receiving element 921 and a diffuse reflection light receiving element 922, both as a light receiving element 92.

The detection sensor 90 reads out a pattern on the intermediate transfer belt 61. The readout patterns can be rectangular patches or a plurality of patches arranged serially.

The intermediate transfer belt 61 is stretched over a plurality of rollers 65. As illustrated in FIG. 1, the rollers 65 include a driven roller 651, a drive roller 652, and a support roller 653.

The detection sensor 90 preferably reads out the patterns on the intermediate transfer belt 61 at a position near the roller 65 to avoid winding or shifting of the intermediate transfer belt 61, and more preferably reads out the patterns near the drive roller 652.

FIG. 12 is a view illustrating a state in which the detection sensor reads out the patterns on the intermediate transfer belt.

Figure 12A:
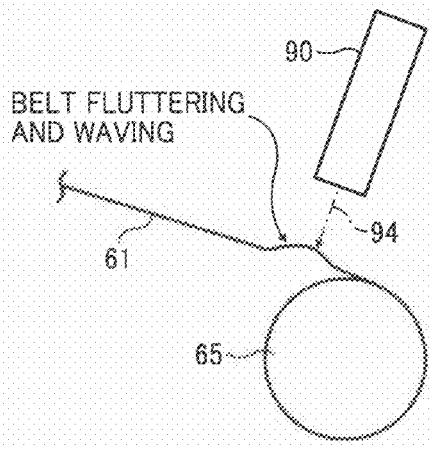
FIGS. 12A-12D illustrate a state in which the detection sensor reads out the patterns on the intermediate transfer belt.

When the detection sensor 90 reads out the patches or the like where the intermediate transfer belt 61 does not wind around any of the rollers 65, the detected output value of the background part of the intermediate transfer belt 61 varies greatly due to the fluttering and waving of the belt 61. Then, although it is preferred that the output value be detected where the intermediate transfer belt winds over the roller, side effects may still occur. However, as illustrated in FIG. 12A, if the detection is performed at a portion apart from the roller winding portion, the fluttering and waving of the intermediate transfer belt 61 may occur.

Figure 12B:
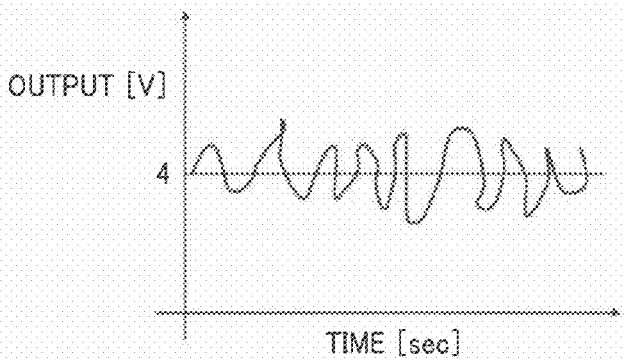
Figure 12C:
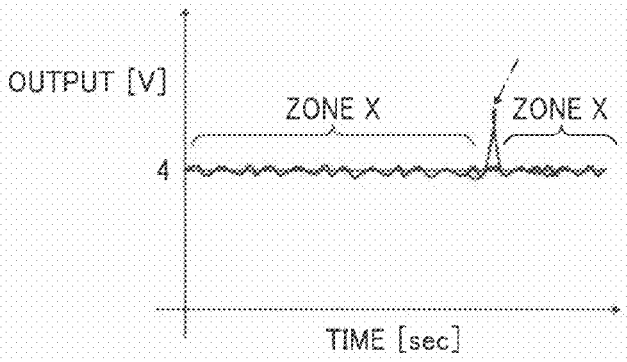

FIG. 12B shows an example in which output level fluctuates due to factors of fluttering of the intermediate transfer belt 61 and concavity/convexity of the surface thereof. The fluctuation may reach ±1 volt and detection errors are critical. FIG. 12C shows output levels when using the conventional roller. To prevent the detection errors, the detection is performed where the intermediate transfer roller winds over a conventional type of roller or in the vicinity thereof. The diameter of the conventional type of roller corresponding to the detection surface is not reduced. In this case, variations are less. As in the zone X in FIG. 12C, variations in the output level due to the fluttering of the intermediate transfer belt 61 and concavity/convexity of the surface thereof are small. In this section, detection precision of the toner deposition amount is high.

However, as illustrated in FIG. 12C indicated by an arrow, not by the factors of fluttering of the intermediate transfer belt 61 or the concavity/convexity of the surface thereof, a sudden output rise occurs due to the projection or dust on the inner surface of the intermediate transfer belt 61 or the roller 65. This sudden output change adversely affects the detection precision.

In particular, in detecting a pattern for alignment control by the specular reflection, the smaller the spot diameter of the light emitting element 91 such as LED becomes, the more precisely the alignment control can be done. However, if the spot diameter is small, the sensitivity of the detection sensor 90 relative to the distance from its sensor head to the detection target surface and relative to the slanted angle increases, and the slight projection or minor fluttering of the intermediate transfer belt 61 causes detection errors in the output values.

Possible causes of the detection error include not only the fluttering of the intermediate transfer belt 61 and its surface concavity/convexity but the dust or projections on the inner surface of the intermediate transfer belt 61. Due to the dust or projections, the intermediate transfer belt 61 locally protrudes at a portion wound over the roller 65, and the distance from the belt surface to the detection sensor 90 or the tilt angle changes, thereby causing variations in the output values. As illustrated in FIG. 12, the variation decreases when the detection sensor 90 performs detection where the intermediate transfer belt 61 is stretched over the roller 65, but a sudden output change over 1 volt may occur due to the dust and projections.

Figure 13:
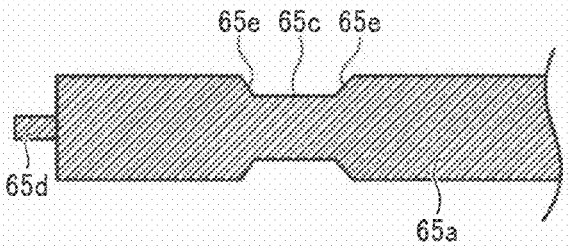
FIG. 13 PRIOR ART
FIG. 13 is a view showing a structure of a conventional drive roller.

FIG. 13 is a view showing a structure of a conventional drive roller.

A drive roller 652 includes a rotation axis made of metal, and a metal core or metal sleeve. In the prior art models, a metal roller 65 formed as a sensor-opposite roller is detected so that only a detection surface is thinned to provide a gap between the intermediate transfer belt 61 and the roller 65. By forming the metal roller 65 as above, even the dust and projections do not cause the intermediate transfer belt 61 to protrude.

Figure 12D:
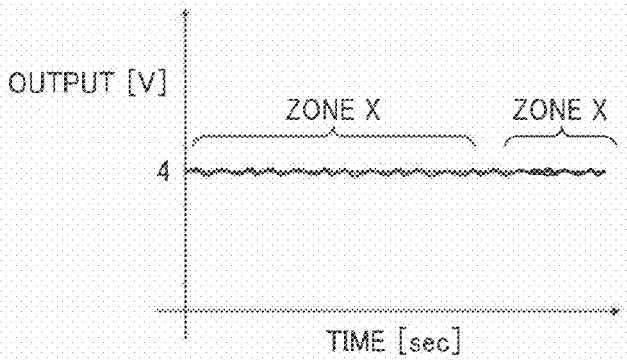

In such a structure, the sudden output change due to the protrusions or dust on the backside of the intermediate transfer belt 61 or the drive roller 652 does not occur, and the output level is stabilized over an entire detection time range and the detection of the toner deposition amount can be performed with higher precision as illustrated in FIG. 12D.

When the drive roller 652 is formed of metal, however, it is necessary to strengthen the tension of the drive roller 652 relative to the intermediate transfer belt 61 to secure the grip power compared to the drive roller 652 formed of rubber. If the tension is too strong, the force to press the intermediate transfer belt 61 by the drive roller 652 becomes strong, thereby causing the portion of the intermediate transfer belt 61 opposite both end portions of the drive roller 652 having a small diameter to be scratched or creased. In this exemplary embodiment, the tension to be applied is set to 1 to 1.5 N/cm in the case of a rubber roller. The tension to be applied to the metal roller is 2 N/cm at the least, and a further adverse effect occurs in this case. To prevent scratches on the intermediate transfer belt 61 opposite the both end portions of the drive roller 652 of reduced diameter, the roller 65 is made to have a smooth curve or tapered. The intermediate transfer belt 61 may even have scratches or creases thereon due to the heavy load of the tension.

In addition, even though a gap 65*c* is provided to the roller 65 to prevent output changes due to the protrusions or the dust on the roller 65, the intermediate transfer belt 61 may be flawed by a tapered surface 65*e* or a step.

Figure 14:
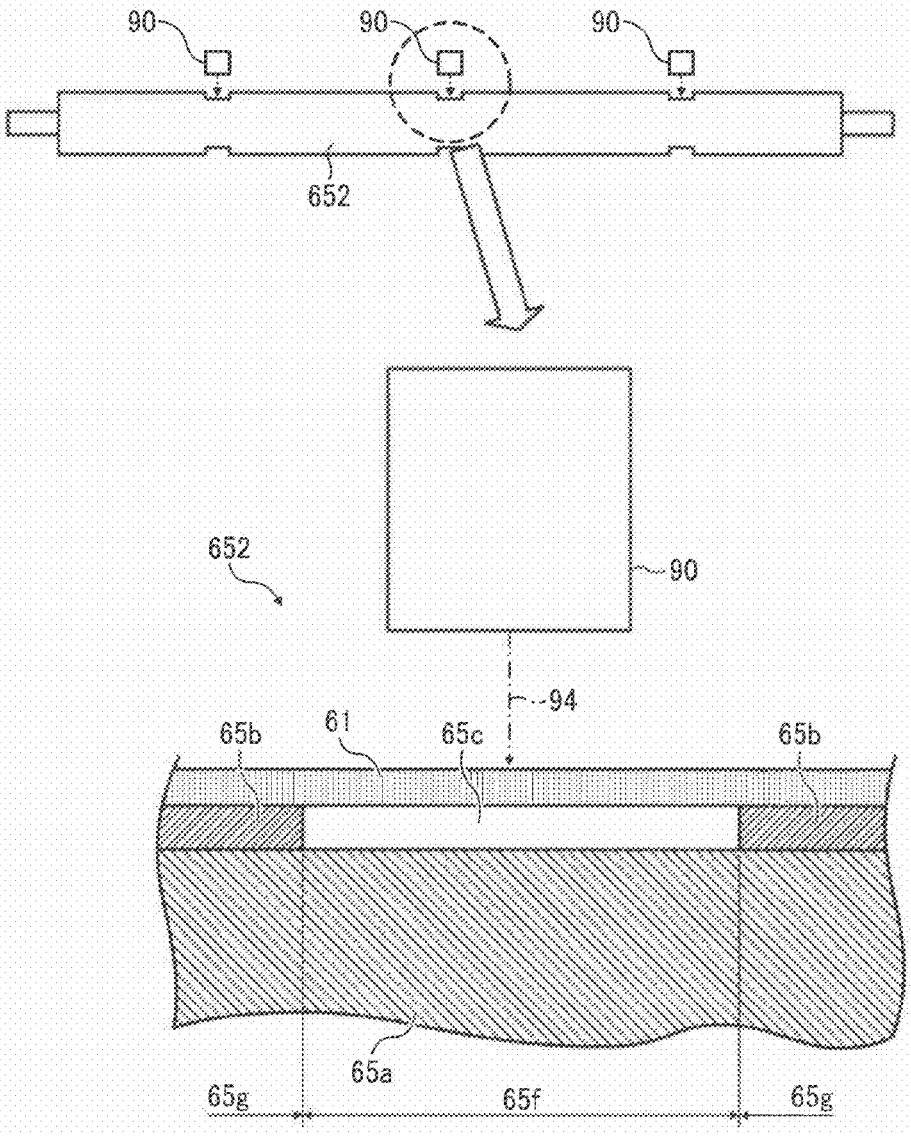
FIG. 14 is a view illustrating a structure of a drive roller for use in an image forming apparatus according to an embodiment of the present invention.

FIG. 14 is a view illustrating a structure of a drive roller for use in an image forming apparatus according to an embodiment of the present invention.

The drive roller 652 includes a first portion 65*f* opposite an area including a pattern passing position of the intermediate transfer belt 61 and a second portion 65*g* contacting the intermediate transfer belt 61 in an area not including the pattern passing position of the intermediate transfer belt 61.

As illustrated in FIG. 14, three detection sensors 90 are disposed in the belt width direction. Each detection sensor 90 detects patches on the intermediate transfer belt 61. The first portion 65*f*, being an area including a detection target surface to detect patches or the like of the drive roller 652, is formed to have a smaller diameter than that of the second portion 65*g* contacting the intermediate transfer belt 61. The drive roller 652 specifically includes a metal core 65*a* and a rubber layer 65*b* of 0.5 mm thick which is provided only on the second portion 65*g* on the metal core 65*a*.

The first portion 65*f* has a width of 10 mm and has no rubber layer 65*b*. The first portion 65*f* is thinner than the second portion 65*g* by 1 mm due to the lack of the rubber layer 65*b*. In the present embodiment, the depth of the rubber layer 65*b* is 0.5 mm, but is not limited thereto. Its depth is preferably 0.5 mm or more. The PI belt of the intermediate transfer belt 61 preferably has a thickness of 0.05 to 0.1 mm, but the protrusion that is unexpectedly formed on the backside thereof may have a thickness of 0.2 mm at the maximum depending on the manufacturing method. Then, the rubber layer 65*b* having the depth of 0.5 mm may be enough to obviate an adverse effect of the protrusion. As to the dust, if any foreign substance of 0.5 mm or more enters, the depth of the rubber layer 65*b* needs to be larger. The thickness of the rubber layer 65*b* formed by winding the rubber on the surface of the metal core 65*a* is 0.5 mm, but is not limited thereto.

By making the diameter of the first portion 65*f*, of the drive roller 652, including the area that includes the detection target surface of the intermediate transfer belt 61, to be thinner than the other portion, a gap 65*c* is formed between the intermediate transfer belt 61 and the drive roller 652. Thus, even if there are dust or protrusions on the backside of the intermediate transfer belt 61, the intermediate transfer belt 61 does not protrude in the first portion 65*f* being the area including the detection target surface of the intermediate transfer belt 61 and no adverse effect is given to the detection results.

In addition, if the diameter of the conventional metal roller is thinned, the belt is caused to have scratches and creases at the area opposite the both end portions of the metal roller. However, by forming the roller with a rubber or an elastic material, flaws or creases can be prevented.

Figure 15A:
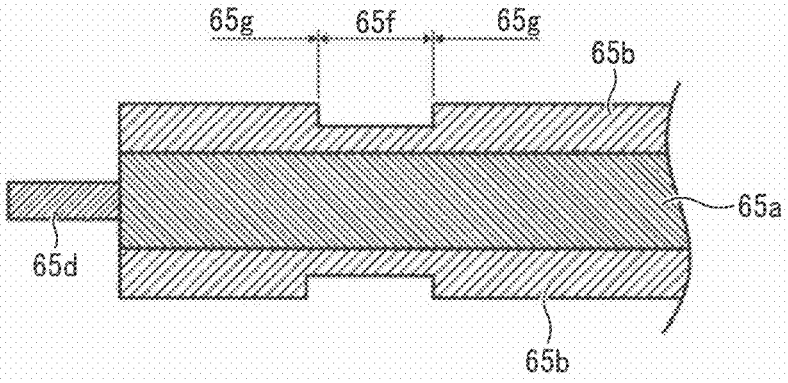
FIGS. 15A and 15B illustrate a structure of the drive roller for use in an image forming apparatus according to an embodiment of the present invention.
Figure 15B:
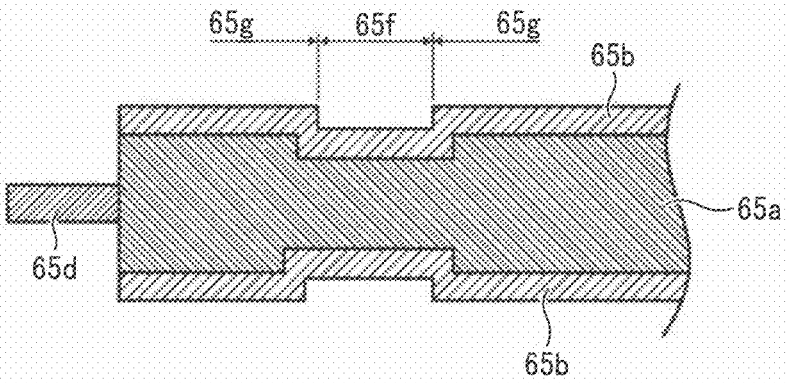

FIGS. 15A and 15B illustrate a structure of the drive roller for use in an image forming apparatus of an embodiment of the present invention.

As illustrated in FIGS. 15A and 15B, a first portion 65*f* is provided with a rubber layer 65*b*. FIG. 15A shows an example in which the rubber layer 65*b* is evenly formed on a metal core 65*a* of the drive roller 652, and part of the rubber layer 65*b* is cut off to form the first portion 65*f*. FIG. 15B shows an example in which part of the metal core 65*a* of the drive roller 652 is cut off to form a cut-off groove, and a rubber layer 65*b* is evenly formed thereon, thereby forming a first portion 65*f*. Either way may be used to form a first portion 65*f*, and alternatively, the first portion 65*f* without a rubber layer 65*b* may be used for the present embodiment.

The roller diameter of the drive roller 652 to be used here is preferably ϕ16 mm or more in the largest part thereof. This is because when most intermediate transfer belt 61 is formed of polyimide (PI) and left without being used over a long period of time, the roller diameter of ϕ16 mm or more does not give an adverse effect, such as stripes, to the formed image due the winding of the intermediate transfer belt 61 occurring at the roller winding portion.

When a mechanism to remove the belt tension is provided after the image forming apparatus is left without being used over a long period of time, the roller diameter of the drive roller 652 may be less than ϕ16 mm. When the belt tension is 1 N/cm or more, the roller diameter is preferably ϕ16 mm or more. The metal core is formed of extruded aluminum in the present embodiment. However, any metal may be used. A rubber layer 65*b* using ethylene propylene rubber having a thickness of 0.5 mm is wound around the metal core.

Figure 16A:
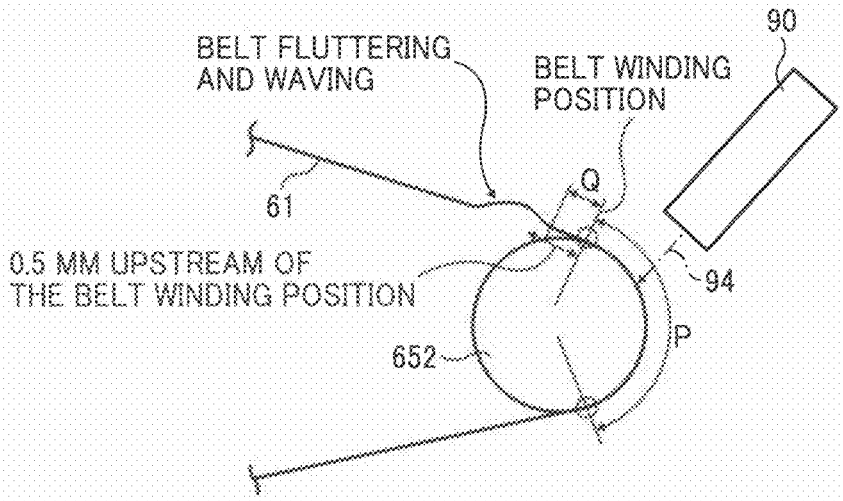
FIGS. 16A and 16B illustrate a state in which a detection sensor detects a pattern on the intermediate transfer belt in the image forming apparatus according to one embodiment of the present invention.
Figure 16B:
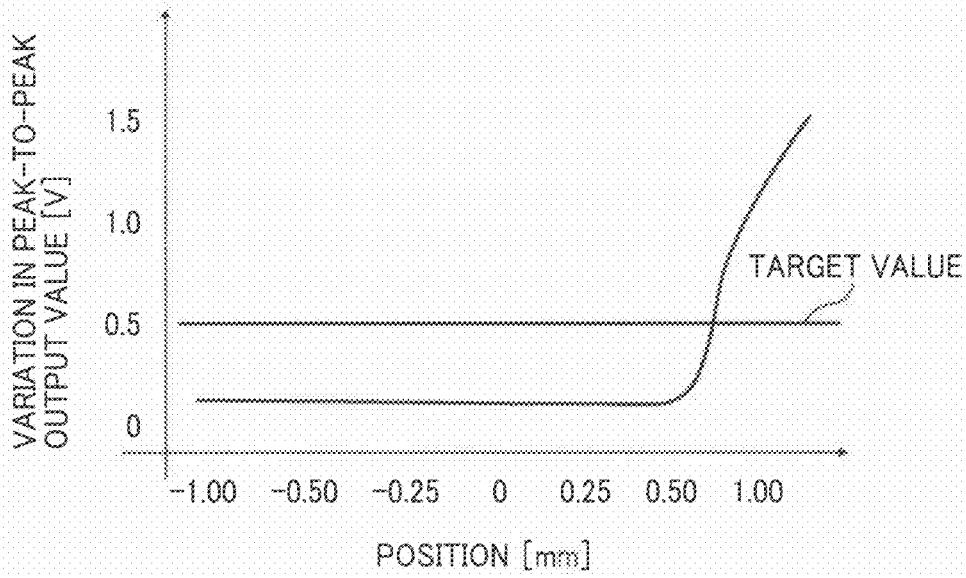

FIGS. 16A and 16B illustrate a state in which a detection sensor detects a pattern on the intermediate transfer belt in the image forming apparatus according to one embodiment of the present invention.

FIG. 16A schematically represents a structure of part of the drive roller 652.

FIG. 16B shows a relation between belt winding positions (in mm) and variations in peak-to-peak output value (in volt). The winding position is set to be 0 mm at the position in which the belt is fitted on the drive roller and the downstream side thereof is set to be a minus (−) side and the upstream side thereof is set to be a plus (+) side. Accordingly, −1 mm shows a position in which the intermediate transfer belt 61 winds over the drive roller 652.

Accordingly, the output value variation drastically decreases from +0.5 mm, and the output value variation becomes less than 0.5 volts being a target value in the downstream (−) side.

From this result, as illustrated in FIG. 16A, the detection sensor 90 preferably is provided to the following two ranges: a range on which the intermediate transfer belt 61 winds on the second portion 65*g* of the drive roller 652, which is a range P in the figure; and a range on which the intermediate transfer belt 61 winds on the drive roller 652 from a position to start winding on the belt to within 0.5 mm upstream thereof, which is a range Q in the figure.

In particular, it is most effective to dispose the detection sensor 90 in the range P in the figure in which no fluttering or waving of the intermediate transfer belt 61 occurs.

Seeing the drive roller 652 from the axis direction, if the detection sensor 90 is in the winding position of the belt 61 over the drive roller 652 or in the range within 0.5 mm upstream from the belt winding position, the peak-to-peak output voltage can be within the designed target value even though the distance between the detection sensor 90 and the detection target surface of the intermediate transfer belt 61 varies due to the fluttering or waving of the belt 61.

Figure 17:
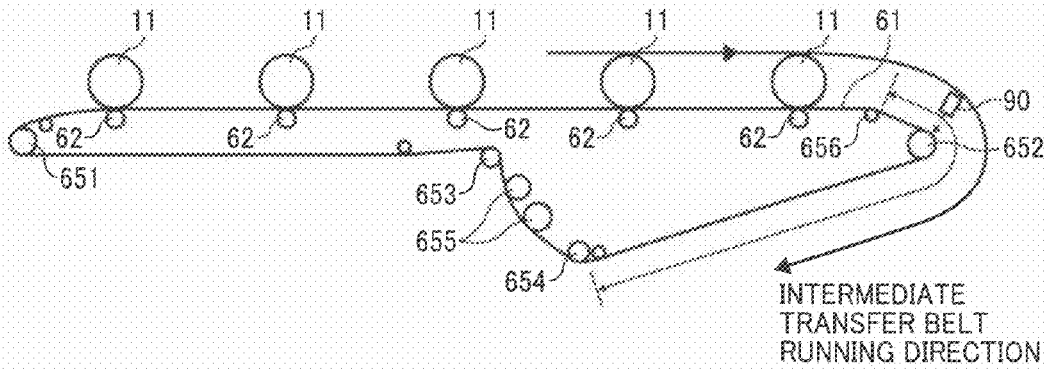
FIG. 17 shows a structure of a transfer unit to which the detection sensor is disposed in the image forming apparatus according to an embodiment of the present invention.

FIG. 17 shows a structure of a transfer unit to which the detection sensor is disposed in the image forming apparatus of the present embodiment of the present invention.

As illustrated in FIG. 17, the intermediate transfer belt 61 is stretched taut over a plurality of rollers 65 including the drive roller 652. In a state in which a toner image formed by a plurality of photoreceptors 11 is carried on the intermediate transfer belt 61, the intermediate transfer belt 61 is driven by the drive roller 652 to run in the direction indicated by an arrow. The toner on the intermediate transfer belt 61 is transferred onto a recording medium 6 such as a sheet of paper which enters in an aligned manner into a nip formed between a repulsive force roller 654 and a secondary transfer roller 63 provided opposite the repulsive force roller 654. Downstream of the repulsive force roller 654, a belt cleaning device 64 to remove residual toner deposited on the intermediate transfer belt 61 is provided. A tension roller 653 is further provided to give tension to the intermediate transfer belt 61 from an upper side of the belt 61. Part of the photoreceptor 11 (four left ones in the figure) can be detached from the intermediate transfer belt 61 when the primary transfer roller 62 provided opposite the photoreceptor 11 to press it from the backside of the belt 61 is detached from the photoreceptor 11.

In this exemplary embodiment, the image forming apparatus 1 includes a photoreceptor 11, a backup roller 656, and a drive roller 652 in the belt running direction. The detection sensor 90 is disposed above the intermediate transfer belt 61 at a position between the backup roller 656 and the drive roller 652.

The detection sensor 90 is disposed opposite the intermediate transfer belt 61 at a position receiving a tension from the drive roller 652 which has a grooved portion. The detection sensor 90 is preferably disposed opposite the intermediate transfer belt 61 at any position from which a backup roller 656 disposed slightly upstream of the drive roller 652 comes out of contact with the intermediate transfer belt 61 to which the repulsive force roller 654 disposed downstream of the drive roller 652 comes into contact with the intermediate transfer belt 61. By this disposition, the groove of the drive roller 652 can reduce a degree that the intermediate transfer belt 61 is protruded and gives no adverse effect to the detection results.

As described above, the degree to cause the intermediate transfer belt 61 to be protruded is reduced. Also, considering the variations in the output level due to the fluttering and waving of the intermediate transfer belt 61, it is preferred that the detection sensor 90 be disposed in a range P or Q as illustrated in FIG. 16A, whereby the adverse effect to the detection results can be more securely prevented.

The detection sensor 90 reads toner patterns formed in the plurality of photoreceptors 11 for controlling toner density or positional alignment.

To control positional errors of the toner image in the belt width direction (that is, main scanning direction) of the intermediate transfer belt 61, multiple detection sensors 90 and toner patterns are preferably provided in the belt width direction. Thus, for example, in the present embodiment, three detection sensors 90 are provided, and the toner patterns are also provided at positions corresponding to those three detection sensors 90. In the illustrated example, the detection sensor 90 is disposed downstream of the photoreceptor 11 with the backup roller 656 sandwiched therebetween. Then, whether the photoreceptor 11 contacts or is detached from the intermediate transfer belt 61 does not affect the positional relation between the detection sensor 90 and the intermediate transfer belt 61.

In the illustrated example, the detection sensor 90 is provided at 2 mm downstream of a position in which the intermediate transfer belt 61 starts to wind over the drive roller 652. In this case, there is no fluttering or waving of the intermediate transfer belt 61, the same positional relation between the detection sensor 90 and the intermediate transfer belt 61 is maintained, and the detection of the patterns can be performed with higher precision.

The drive roller 652 needs to secure a sufficient frictional force or gripping force at the belt winding portion to firmly transmit the driving force to the intermediate transfer belt 61. Accordingly, tension of the belt needs to be strengthened. If the tension is too high, however, the intermediate transfer belt 61 is pressed by the drive roller 652 excessively and tends to be scratched or creased by the corners of the groove end portions on the drive roller 652. In the present embodiment, the second portion 65*g* on the surface of the drive roller 652 is formed of an elastic member, thereby securing the gripping force with low tension, and scratches or creases can be prevented due to the low tension. Further, by forming the contact portion of the drive roller 652 with the intermediate transfer belt 61 with rubber or an elastic material to impart softness, scratches or creases may be prevented more effectively.

According to the above structure, the positional relation between the detection sensor 90 and the intermediate transfer belt 61 can be maintained by the tension from the driving force given by the drive roller 652 to the intermediate transfer belt 61. In addition, since the belt tension is favorably controlled, scratches and creases on the belt 61 can be prevented. Furthermore, since the intermediate transfer belt 61 contacts the drive roller 652 at a portion formed of the elastic material, scratches and creases can be more adequately prevented.

[Description of the Roller Manufacturing Method in the Exemplary Embodiment]

Figure 18A:
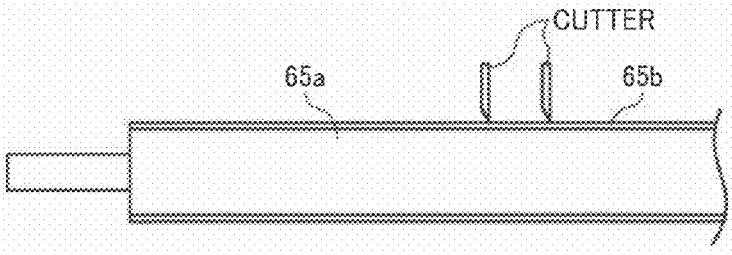
FIGS. 18A and 18B show a manufacturing method of the drive roller for use in the image forming apparatus according to an embodiment of the present invention.
Figure 18B:
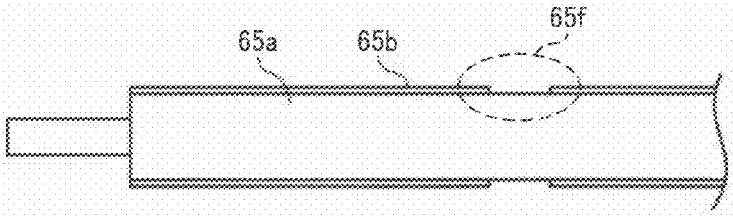

FIG. 18 shows a manufacturing method of the drive roller for use in the image forming apparatus of an embodiment of the present invention.

As illustrated in FIG. 18A, a metal core 65*a*, a core material, has a substantially same diameter in the belt width direction. A rubber layer 65*b*, an elastic material, is formed on the metal core 65*a*.

Then, using a cutter or a lathe, the rubber layer 65*b* is cut at both end portions of the groove along a circumferential direction of the metal core 65*a*. Then, the groove portion is removed from the rubber layer 65*b* to form a gap 65*c* (in the first portion 65*f*). The groove portion is a portion opposite the area on the intermediate transfer belt 61 including a reading position of the detection sensor 90.

To produce a conventional drive roller as illustrated in FIG. 13, at least right and left tapered surfaces and groove surface need to be prepared along the circumferential surface. Processes to form three types of cuts each having a different angle are required and take a lot of trouble. In particular, the inclined taper surface requires complex and troublesome tasks. Polishing the metal roller formed of uniform metal material to secure the roller strength is also a troublesome task.

According to the manufacturing method as illustrated in FIG. 18, only by removing part of the rubber layer 65*b* of which both ends are cut, a boundary between the metal core 65 and the rubber layer 65*b* forms a groove surface and another task to form a groove surface by cutting can be saved. Only by cutting the rubber layer 65*b* up to a position to reach the metal core 65*a*, and by stopping cutting it when reaching the metal core 65*a*, there is no trouble to set the cutting depth in detail as in the case of cutting a single member. In reducing the diameter of a rubber roller, the rubber roller is in general thinned by being ground by a desired volume while rotating the roller, which is time-taking. The method to cut the rubber by forming the rubber layer 65 on the surface of the metal core 65*a* is easy and simple since the diameter can be thinned only by inserting a blade of the cutter into the rubber layer 65*b* and making one rotation of the roller.

In the present embodiment, the cuts on the both end portions are inserted to the same direction as the radius direction of the metal core 65*a*. Then, the groove portion can be formed only by cutting the rubber layer 65*b* in the direction perpendicular to the drive roller 652 and to the belt width direction, which makes the cutting work by rotating the drive roller 652 or the cutter along the circumferential direction to be stable and easily processable.

Modified Example

As illustrated in FIG. 15, a rubber layer 65*b* formed on the metal core 65*a* having a same diameter is formed to have a different thickness in the belt width direction. Alternatively, a metal core 65*a* with a different diameter in the belt width direction is first formed and a thin rubber layer 65*b* is formed on the metal core 65*a* to form a drive roller 652.

If there is a layout-derived restriction from the transfer unit 60 having an intermediate transfer belt 61, any roller 65 other than the drive roller 652 is formed with a groove and a detection sensor 90 may be provided either upstream or downstream of the roller 65 on which the groove is formed.

A gap 65*c* may be formed not only to a single roller 65 but to a plurality of rollers 65 or all rollers 65 which contact the intermediate transfer belt 61. The gap 65*c* may be provided to all rollers other than the repulsive force roller 654 disposed opposite in the secondary transfer position.

Part of the rubber layer 65*b* at end portions of the gap 65*c* may be tapered. In an apparatus using a direct transfer method in which images are directly transferred from the photoreceptor 11 to the recording medium 6, rollers for the conveyance belt 66 may be formed with such gaps. Rollers to support a belt-shaped photoreceptor or a photoreceptor belt may also be provided with such gaps.

Patterns are not only the toner images but patterns regularly disposed outside the image forming area on the intermediate transfer belt 61. Patterns are not only limited to control the positional alignment or the toner density, but may be marks and the like disposed at the belt end portion to detect a running direction or a position in the width direction of the intermediate transfer belt 61.

The toner used in the present embodiment is polymerized toner prepared by a polymerization method.

Figure 19:
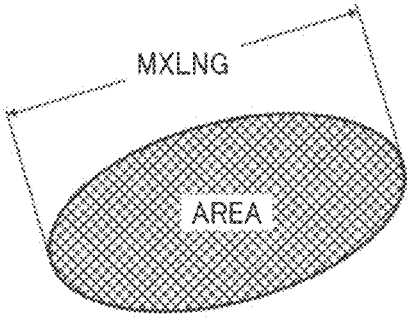
FIG. 19 schematically shows a toner shape to explain the shape factor SF1.
Figure 20:
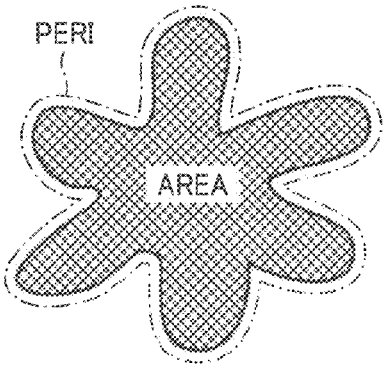
FIG. 20 schematically shows a toner shape to explain the shape factor SF2.

The shape factor SF1 of the toner used for the present embodiment is preferably in a range from 100 to 180 and SF2 in a range from 100 to 180. FIGS. 19 and 20 each schematically show a toner shape to explain the shape factor SF1 and the shape factor SF2. Specifically, the shape factor SF1 shows a degree of circularity of a toner particle, and is represented by the following equation (1). A value produced by dividing the square of the maximum length MXLNG of an oval figure, which is the projection of the toner particle in a two-dimensional plane, by the area of the figure AREA and then multiplying the resulting quotient by 100π/4.

$$SF1=\{(MXLNG)^2/AREA\}\times(100\pi/4) \quad (1)$$

If the value of SF1 becomes 100, the toner shape is a true sphere. The greater the value of SF1, the more amorphous the toner shape becomes.

The shape factor SF2 is a value representative of the ratio of irregularity in the shape of toner and is represented by the following equation (2). A value produced by dividing the square of the peripheral length PERI of a figure, which is the projection of the toner in the two-dimensional plane, by the area AREA of the figure and then multiplying the resulting quotient by 100/4 π.

$$SF2=\{(PERI)^2/AREA\}\times(100/4\pi) \quad (2)$$

If the value of SF2 becomes 100, no irregularity on the toner surface exists. The greater the value of SF2 is, the more remarkable the irregularity on the toner surface.

Measurements of the shape factors are done as follows. Specifically, a photograph of toner is taken using Scanning electroscope (S-800, trade name, manufactured by Hitachi, Ltd.) and the image is analyzed by Image Analyzer (LUSEX3, trade name, manufactured by NIRECO Corp.).

If the toner shape becomes near the sphere, toner-to-toner or toner-to-photoreceptor contact is made only by point-to-point contact, and the toner-to-toner attracting power decreases, thereby increasing the fluidity. The attracting power between the toner and the photoreceptor also decreases, thereby increasing the transferability. If either of the SF1 and SF2 exceeds 180, the transferability decreases and the cleanability of the toner attached to the transfer device also decreases, which is not favorable.

It is in general believed that the toner particle with a diameter as small as possible is favorable to form a high resolution and high quality image. By contrast, the too-small-sized toner has a disadvantage as to the transferability or the cleanability.

The favorable toner particle diameter is in a range from 4 to 10 μm. If the toner particle diameter is less than 4 μm, background contamination is caused during the development, fluidity is degraded and agglomeration tends to occur, and then, the white omission tends to occur.

On the contrary, if the toner particle diameter is greater than 10 μm, toner dispersion occurs and a high quality image cannot be obtained due to the degraded resolution. In the present embodiment, toner with the volume average particle diameter of 6.5 μm is used.

If the toner having the volume average particle diameter of 4.0 μm or less is used in the two-component developer, toner is melted on the surface of magnetic carriers by agitation for a long time inside the developing device, whereby chargeability of the magnetic carrier is reduced. If used as one-component developer, phenomena such as toner filming to the developing roller, toner melting to the parts such as a blade to thin the toner layer tend to occur.

By contrast, if the volume average particle diameter of toner exceeds 10.0 μm, a high quality image with high resolution cannot be obtained easily, and the variations in the particle diameter of toner increase during the toner supply and expenditure within the developer.

When the ratio Dv/Dn of the volume average particle diameter Dv to the number average particle diameter Dn exceeds 1.40, the charge distribution expands and the resolution degrades, and therefore it is not preferable. The ratio Dv/Dn can be controlled by adjusting the aqueous phase viscosity, oil phase viscosity, property and added amount of the resin fine particles, and the like. In addition, the values Dv and Dn can be controlled, for example, by adjusting the property and the added amount of the resin fine particles.

The average particle diameter and the particle size distribution can be measured by Coulter Counter TA-11 or Coulter Multisizer (manufactured by Beckman Coulter, Inc.).

The measuring method is as follows: First, 0.1 to 5 ml of surfactant, for example, alkylbenzene sulfonate is added as dispersant into 100 to 150 ml of electrolytic aqueous solution, then, 2 to 20 mg of sample is added and suspended in the electrolytic aqueous solution, and dispersed for about 1 to 3 minutes by a ultrasonic disperser. The thus prepared sample is measured by the above Coulter Counter or Multisizer using 100 μm aperture to obtain the toner volume distribution and number distribution included in the sample by calculating the toner particles volume and numbers per each channel. As the electrolytic solution, ISOTON R-II (manufactured by Coulter Scientific Japan) which is approximately 1% NaCl solution prepared by using sodium (I) chloride was used. To briefly explain image forming operation, first, the exposure unit 12 radiates laser beams to the surface of each of negatively charged photoreceptor 11 to form electrostatic latent images of each color thereon. Next, the electrostatic latent images are developed by toner of a predetermined color having the same polarity (negative polarity) as the charged polarity of the photoreceptor 11 by the developing unit 40 and are visualized. In this case, an endless intermediate transfer belt 61 stretched over and supported by a plurality of rollers 651 to 653 is so provided and rotated above the photoreceptors 11Y, 11C, 11M, and 11K as to contact part of each of the photoreceptors 11Y, 11C, 11M, and 11K after the development process. Toner images formed on each of the photoreceptor 11Y, 11C, 11M, and 11K are sequentially transferred onto the intermediate transfer belt 61 via the first transfer rollers 62Y, 62C, 62M, and 62K, thereby forming a non-fixed superimposed image. The belt cleaning device 64 is provided at a position opposite the cleaning backup roller 655 and in the outer periphery of the intermediate transfer belt 61. This belt cleaning device 64 takes off residual toner remaining on the surface of the intermediate transfer belt 61 and foreign substances such as paper dust. The secondary transfer roller 63 is provided at a position opposite the support roller 653 and in the outer periphery of the intermediate transfer belt 61. The recording medium 6 passes through a nip between the intermediate transfer belt 61 and the secondary transfer roller 63. While the recording medium 6 passing through the nip, the secondary transfer roller 63 is applied with bias, whereby the toner image carried on the intermediate transfer belt 61 is transferred to the recording medium 6. The polarity of the transfer bias voltage to be supplied to the secondary transfer roller 63 is positive which is opposite that of the toner. These parts or components related to the intermediate transfer belt 61 are integrally constructed as a transfer unit 60 which is detachably disposed in the image forming apparatus 1.

Figure 21:
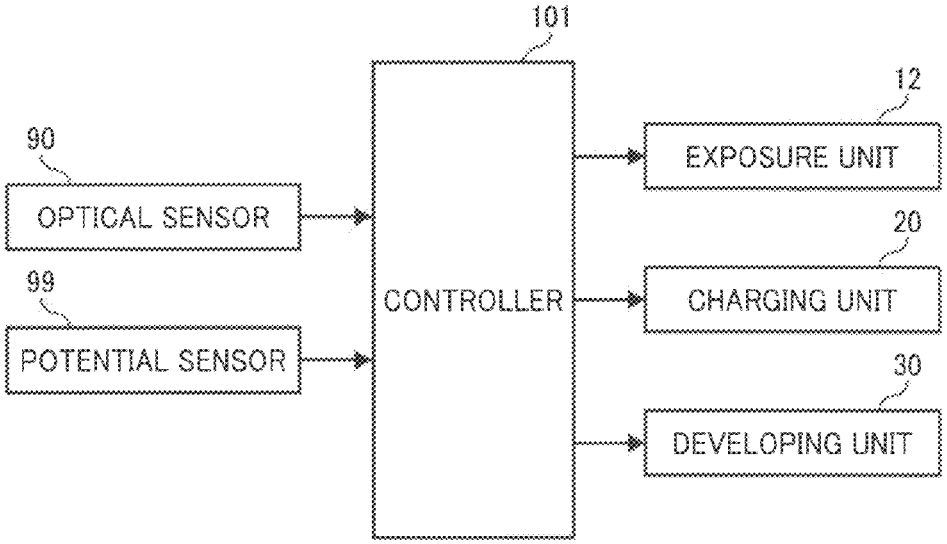
FIG. 21 is a block diagram of a controller and related structural units in the image forming apparatus according to an embodiment of the present invention.

FIG. 21 is a block diagram of a controller 101 and related structural units in the image forming apparatus according to one embodiment of the present invention. The controller 101 may be implemented as a central processing unit (CPU), provided with associated RAM and ROM memory units, and operates by loading and executing programs stored in the memory units to perform desired functions.

As illustrated in FIG. 21, each of the photoreceptors 11Y, 11C, 11M, 11K includes a potential sensor 99 disposed downstream of the charging unit 20 in the circulating direction of the photoreceptor 11 and upstream of the developing unit 30. Before image forming operation, the potential sensor 99 previously detects electric potential of the photoreceptor 11. Next, the optical sensor 90 detects toner deposition amount using the patch-like patterns on the intermediate transfer belt 61. The data of the charged potential detected by the potential sensor 99 and the data of the toner deposition amount detected by the detection sensor 90 are processed by the controller 101 included in the image forming apparatus 1. The controller 101 performs various controls on the actual image formation, such as charged bias of the charging unit 20, light amount of the exposure unit 12, development bias of the developing unit 30, and the like.

A sheet feed device 80 provided in the bottom of the image forming apparatus 1 includes sheet feed cassettes 81 each of which contains recording media to be supplied, if required. From one of the sheet-feed cassettes 81, a sheet of the recording media 6 is securely fed to the registration roller 84 by the conveyance roller 82. Further, the recording medium 6 is conveyed to the fixing device 70 provided downstream in the sheet conveying direction. The recording medium 6 on which the image has been fixed is discharged to the sheet discharge tray provided outside the image forming apparatus 1 and is stacked thereon.

Additional modifications and variations of the present invention are possible in light of the above teachings. It is therefore to be understood that, within the scope of the appended claims, the invention may be practiced other than as specifically described herein.

What is claimed is:

1. An image forming apparatus comprising:

an endless, rotatable intermediate transfer belt;

a plurality of rollers around which the intermediate transfer belt is rotatably entrained, including at least first, second, and third rollers, the first roller having a core, at least one elastic member, a first portion, and a second portion, the at least one elastic member is disposed on the core and defines a groove corresponding to the first portion, the first portion having a diameter smaller than a diameter of the second portion, the first portion disposed opposite an area on the intermediate transfer belt including a pattern, the second portion contacting the intermediate transfer belt at an area on the intermediate transfer belt not including the pattern; and a detector to read the pattern on the intermediate transfer belt, disposed opposite the intermediate transfer belt between the second roller disposed upstream from the first roller and the third roller disposed downstream from the first roller.

2. The image forming apparatus as claimed in claim 1, wherein:

a diameter of the core is constant and equal to the diameter of the first portion of the first roller.

3. The image forming apparatus as claimed in claim 1, wherein the first roller is a drive roller that drives the intermediate transfer belt.

4. The image forming apparatus as claimed in claim 1, wherein boundaries between the first and second portions of the first roller are stepped in a radial direction of the first roller.

5. The image forming apparatus as claimed in claim 1, wherein the diameter of the first portion of the first roller is at least 1 mm smaller than the diameter of the second portion.

6. The image forming apparatus as claimed in claim 1, wherein the detector detects a surface of the intermediate transfer belt within 0.5 mm upstream of where the intermediate transfer belt contacts the first roller.

7. The image forming apparatus as claimed in claim 1, further comprising a latent image carrier, wherein the pattern is a toner density pattern and is transferred to the intermediate transfer belt after being formed on the latent image carrier.

8. The image forming apparatus as claimed in claim 1, further comprising a latent image carrier, wherein a pattern for use in positional alignment control is a toner image pattern first formed on the latent image carrier and subsequently transferred to the intermediate transfer belt, and the detector detects the pattern by reading specular reflection light reflected by the pattern.

9. The image forming apparatus as claimed in claim 1, wherein the detector includes a specular reflection light receiving element and a diffuse reflection light receiving element.

10. The image forming apparatus as claimed in claim 2, wherein the at least one elastic member includes a plurality of elastic members that are only disposed on a portion of the core that corresponds to the second portion of the first roller.

11. The image forming apparatus as claimed in claim 10, wherein the groove is defined by outer edges of the plurality of elastic members that extend in a radial direction from an outer surface of the core and a portion of the outer surface of the core corresponding to the first portion of the first roller.

12. The image forming apparatus as claimed in claim 2, wherein the at least one elastic member includes one elastic member that surrounds portions of the core corresponding to the first portion and the second portion of the first roller.

13. The image forming apparatus as claimed in claim 12, wherein the groove is formed in an outer surface of the elastic member.

14. The image forming apparatus as claimed in claim 13, wherein the diameter of the groove is at least 1 mm smaller than a portion of the elastic member where the groove is not formed in the outer surface of the elastic member.

15. The image forming apparatus as claimed in claim 2, wherein the diameter of the core is at least 1 mm smaller than a diameter of an outer surface of the at least one elastic member.

* * * * *